US005121027A

United States Patent [19]

No

[11] Patent Number: 5,121,027

[45] Date of Patent: Jun. 9, 1992

[54] OXIDE-COATED CATHODE FOR CRT AND MANUFACTURING METHOD THEREOF

[75] Inventors: Hrvan-Chul No, Seoul; Jong-In Jeony, Kyongki-do; Jong-Seo Choi, Seoul; Jong-Ho Oh, Kyongki-do; Kyu-Nam Ju, Seoul, all of Rep. of Korea

[73] Assignee: Samsung Electron Devices Co., Ltd., Kyongki, Rep. of Korea

[21] Appl. No.: 746,902

[22] Filed: Aug. 19, 1991

[30] Foreign Application Priority Data

Aug. 18, 1990 [KR] Rep. of Korea ..... 90-12728

[51] Int. Cl.[5] ..... H01J 19/06; H01J 9/04

[52] U.S. Cl. ..... 313/346 R; 313/270; 313/355; 445/50; 445/51; 427/77; 427/78

[58] Field of Search ..... 313/346 R, 346 DC, 355, 313/270; 445/50, 51; 427/77, 78

[56] References Cited

U.S. PATENT DOCUMENTS 4,797,593 1/1989 Saito et al. ..... 313/346 R
4,864,187 9/1989 Sano et al. ..... 313/346 R
5,041,757 8/1991 Longo et al. ..... 313/346 DC

FOREIGN PATENT DOCUMENTS 61-271732 12/1986 Japan .
63-254635 10/1988 Japan .
1-77819 3/1989 Japan .
1-102829 4/1989 Japan .

*Primary Examiner*—Donald J. Yusko
*Assistant Examiner*—Diab Hamadi
*Attorney, Agent, or Firm*—Cushman, Darby & Cushman

[57] ABSTRACT

This invention relates to an oxide-coated cathode for CRT and a manufacturing method thereof, where Scandium(Sc) or Scandium Oxide($Sc_2O_3$) is vaporized and ionized into a gas state under the oxygen existing environment, and is accelerated onto the surface of a base of Ni containing small amounts of a reducing element such as Mg or si to form an implantation layer in a certain depth within the base, whereby enhancing the electron emissive characteristics and lengthening the longevity of the cathode.

7 Claims, 2 Drawing Sheets

OXIDE-COATED CATHODE FOR CRT AND MANUFACTURING METHOD THEREOF

BACKGROUND OF THE INVENTION

1. Field of the Invention

This invention relates to an oxide-coated cathode for CRT and a manufacturing method thereof, and more particularly to an oxide-coated cathode and its manufacturing method which can enhance the electron emissive characteristics and the longevity of the cathode by improving the distribution features of the electron-emissive substance with an ion implantation method.

2. Description of the Prior Arts

In conventional structure of a cathode for cathode ray tube as shown in FIG. 1, a cap 1, applied with an electron-emissive substance, e.g., a carbonate 2, is secured to a sleeve 3 by welding. The electron emissive substance is prepared as following.

A ternary carbonate of $BaCO_3$, $CaCO_3$ and $SrCO_3$ made from an alkaline earth metal elements of Ba, Sr and Ca is mixed with a binder and a solvent to make a suspension. This suspension is sprayed onto a base made of Ni as a major element containing small amounts of a reducing element such as Mg or Si, The applied suspension is heated in a vacuum to convert it into the ternary composite oxide which is used as an electron-emissive substance That is, such conversion that the ternary carbonate is heated in a vacuum can be expressed by the following reaction formula.

$$BaCO_3 \longrightarrow BaO + CO_2$$

$$CaCO_3 \longrightarrow CaO + CO_2$$

$$SrCO_3 \longrightarrow SrO + CO_2$$

The $CO_2$ gas generated from the above reaction is discharged by a evacuation pump, and the ternary carbonate is converted into the ternary composite oxide of(-Ba,Ca,Sr)O.

When said the ternary composite Oxide is aged at a temperature of 700–800° C., it is reduced at the interface with the base of Ni by the reducing element to produce free Ba. This free Ba may play a role as a donor which contributes to the electron emission operation.

Here, when the operation of the electron emission may be continued for a long period, the ternary composite oxide of (Ba,Ca,Sr)O reacts with the reducing element in the base of Ni to produce an oxide layer. Such oxide layer is so called "intermediate layer" which is a composite oxide layer composed of $MgSiO_3$ or $BaSiO_3$, etc. Said intermediate layer comes to inhibit the diffusion of the reducing element, whereby free Ba generation is limited. Accordingly, such a conventional cathode has defects of poor electron emissive characteristics and short longevity.

To solve the above mentioned defects, various prior arts are proposed in U.S. Pat. No. 4,797,593 or 4,864,187, Japanese Patent Laid Open SHOWA 61-271,732, 63-254,635, 64-77,819, or HEISEI 1-102,829. These patents disclose at least one of the technics that one or two elements in the group of rare earth metal elements such as In, Ga, or Sc, and the like is added to the ternary carbonate by using a dispersion method, a deposition method, or coprecipitation method in order to increase the generation of free Ba, thereby lengthening the longevity of the cathode and providing with high current density.

For example, Scandium(Sc) which is added to the ternary carbonate acts in reducing the intermediate layer of composite oxide which raises the above mentioned defects, thereby it provides with an effect of limiting the formation of the intermediate layer.

However, as described in Japanese Patent Laid open SHOWA 64-77,819 and HEISEI 1-102,829, the dispersion method where Sc is mixed with the ternary carbonate in a powder state of $Sc_2O_3$, or the deposition method where the ternary carbonate is deposited in the Scandium solution has the below defect; the distribution characteristics of the Sc is poor due to the differences of specific gravity and cohesiveness between the respective elements.

Moreover, the coprecipitation method where Sc and the ternary carbonate are concurrently deposited and precipitated therefrom results in similar problems as in the conventional cathode owing to the creterion of the amount of Sc for deposition.

Meantime, in order to solve the aforementioned defects, there is proposed with a technique where Sc is coated on the surface of the base of Ni to form a layer by using a sputtering method or a heat evaporation method. But such a method has a problem that the coated Sc layer on the base acts as an obstruction layer to isolate the carbonate from the reducing element so that the generation of the free Ba is inhibited. Another art where small amounts of Sc is directly added during the manufacturing procedure of the base of Ni is proposed, which results in raising the manufacturing costs.

SUMMARY OF THE INVENTION

It is an object of the present invention to provide an oxide-coated cathode which is capable of enhancing the electron emissive characteristics where Scandium is uniformly distributed on the surface and within the interior of the base of Ni containing small amounts of the reducing element.

It is another object of the present invention to provide a manufacturing method for an oxide-coated cathode which is capable of enhancing the electron emissive characteristics where an ionized Sc or $Sc_2O_3$ is implanted into the surface and within the interior of the base of Ni containing small amounts of the reducing element, and then a suspension having a carbonate is sprayed thereon.

To accomplish the above mentioned objects, this invention is constituted as follows; an ionized Sc is accelerated onto the surface of a base of Ni as a major element by using an ion implantation method to a depth of 200–3000Å from the surface of the base, and a suspension of a ternary composite oxide containing $BaCO_3$, $CaCO_3$,and $SrCO_3$ is coated by using a spray method onto the surface of the base to make a cathode.

The present invention can be more fully understood from the following detailed description when taken in conjunction with reference to the accompanying drawings, in which:

DESCRIPTION OF THE PREFERRED EMBODIMENTS

Figure 1:
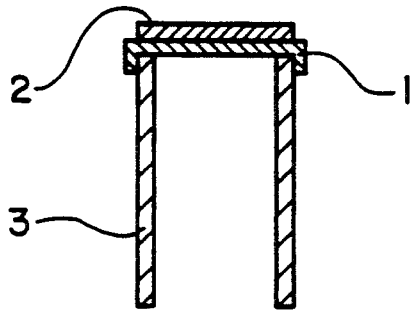
FIG. 1 (PRIOR ART)
FIG. 1 is a partially sectional view showing a conventional oxide-coated cathode.
Figure 2A:
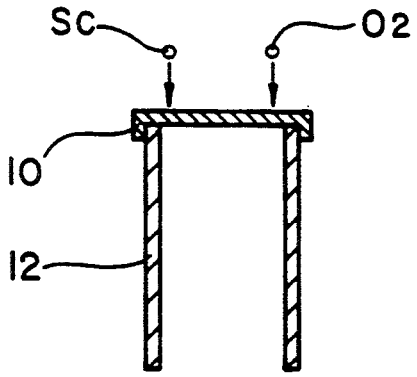
FIG. 2(A) is a schematic view showing a implantation procedure of accelerating an ion onto the base in accordance with the present invention.
Figure 2B:
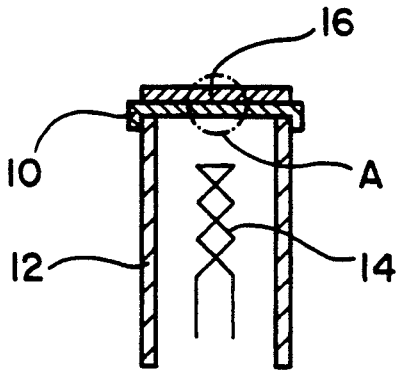
FIG. 2(B) is a schematic sectional view showing a cathode structure in accordance with the present invention.

Referring to FIG. 2 (B), there is shown a cathode structure of this invention where a cap 10 including, a base of Ni as a major element is welded to a sleeve 14 having a heater 12 therein. The base is provided with an electron emissive substance 16 including a ternary carbonate of $BaCO_3$, $CaCO_3$, $SrCO_3$ coated thereon.

As shown in FIG. 2(A), vaporized and ionized Sc or $Sc_2O_3$ in a gas state is accelerated onto the cap 10, e.g., the base of Ni, thereby it is implanted into the base to form an implantation layer where Sc is uniformly distributed in a certain depth.

In case of ionizing the Scandium Oxide($Sc_2O_3$), it is possible to make $Sc_2O_3$ into vapor state by heating, which requires higher temperature to raise the temperature. From the viewpoint as such this embodiment of the present invention propose a method where Sc is vaporized under the oxygen existing environment, and the vaporized Sc and the oxygen is accelerated separately to be implanted into the base of Ni.

At this time, the amount of Sc or $Sc_2O_3$ to be implanted depends upon the initial amounts of the each carbonate. In this embodiment of the present invention, Sc or $Sc_2O_3$ is implanted into the interior of the base and distributed to form an implantation layer in a certain depth(t), e.g., 200–3000Å from the surface of the base according to the degree of the ionization, accelerated voltage, and the surface condition of the base. It is appreciated that the density of the implantation layer in which Sc or $Sc_2O_3$ distributed, is 0.3–0.5 as optimal value relative to that of the matrix, i.e, the base of Ni containing small amounts of reducing element such as Mg or Si.

Figure 3:
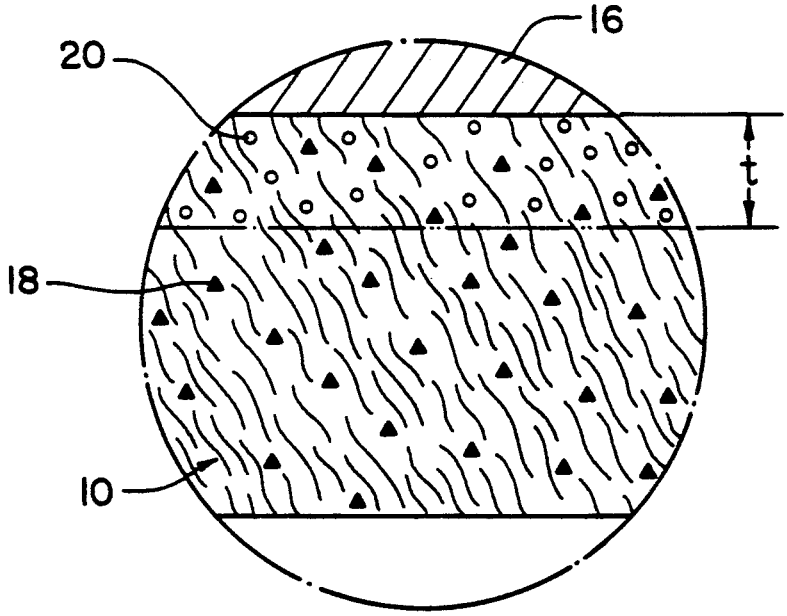
FIG. 3 is an enlarged sectional view of the A portion in FIG. 2(B) showing a schematic upper structure of the base.

Meanwhile, FIG. 3 shows a schematic upper structure of the base adjacent to the electron emissive substance 16 where a reducing element 18 such as Mg or Si and Scandium(Sc) or scandium Oxide ($Sc_2O_3$) 20 are uniformly distributed on the surface and within the cap 10 including the base of Ni. It is understood that the formation of the intermediate layer, which is formed at the interface between the carbonate and the base of Ni to prevent the reducing element from diffusing as in the conventional cathode, is limited due to the uniform distribution of Sc at the interface. Therefore, the generation of free Ba is accelerated to enhance the electron-emissive characteristics and lengthen the longevity of the cathode.

In the above mentioned embodiment of the present invention, a method where an ionized Sc is implanted into the base to Ni by the implantation methodris described. As another embodiment of the present invention, Sc or $Sc_2O_3$ may be sprayed onto the surface of the cap 10 including the base of Ni by using a plasma spray method, and then said Sc is diffused toward the interior of the base of Ni to form an implantation layer similar to that of one embodiment as described above. Such emplantation layer acts and gives rise to same effect as above.

According to the present invention as explained above, it is noted that the formation of the intermediate layer can be limited by uniformly distributing Sc or $Sc_2O_3$ on the surface and within the base of Ni, whereby enhancing the electron-emissive characteristics and lengthening the longevity of the cathode.

Various modifications and changes can be made to one skilled in the art without departing from the spirit and scope of the appended claims.

What is claimed is:

1. An oxide.coated cathode for CRT, comprising:

a cap including a base of Ni as a major element, said cap is welded to a sleeve;

an electron emissive substance including a ternary carbonate of $BaCo_3$, $CaCO_3$, and $SrCO_3$ coated on said base; and a heater for heating said cap within said sleeve, said base of Ni is formed with an implantation layer where Sc or $Sc_2O_3$ is uniformly distributed within the base and on the surface thereof.

2. An oxide.coated cathode in accordance with claim 1, wherein said implantation layer has a depth of 200–3000Å from the surface of said base.

3. An oxide.coated cathode in accordance with claim 1, wherein said implantation layer has a density of 0.3–0.5 relative to that of said base.

4. A manufacturing method of an oxide-coated cathode for CRT, comprising:

step of vaporizing and ionizing Sc or $Sc_2O_3$ by heating under the oxygen existing environment;

step of accelerating said ionized Sc or $Sc_2O_3$ onto the surface of a base of Ni as a major element containing small amounts of a reducing element to form an implantation layer; and step of spraying a suspension having an electron emissive substance of a carbonate onto the surface of said

5. A manufacturing method of an oxide-coated cathode in accordance with claim 4, wherein said implantation layer has a depth of 200–3000Å from the surface of said base.

6. A manufacturing method of an oxide-coated cathode for CRT, Comprising:

step of applying Sc or $Sc_2O_3$ onto the surface of a cap including a base of Ni as a major element by a plasma spray method; and step of spraying a suspension having an electron emissive substance of a carbonate onto the surface of said base; and step of forming an implantation layer by diffusion of Sc toward said base.

7. A manufacturing method of an oxide-coated cathode in accordance with claim 6, wherein said implantation layer has a depth of 200–3000Å from the surface of said base.

* * * * *